US006093260A

United States Patent [19]

Petrone et al.

[11] Patent Number: 6,093,260

[45] Date of Patent: Jul. 25, 2000

[54] SURFACE ALLOYED HIGH TEMPERATURE ALLOYS

[75] Inventors: Sabino Steven Anthony Petrone, Edmonton; Radhakrishna Chakravarthy Mandyam; Andrew George Wysiekierski, both of Fort Saskatchewan, all of Canada

[73] Assignee: Surface Engineered Products Corp., Fort Saskatchewan, Canada

[21] Appl. No.: 08/839,831

[22] Filed: Apr. 17, 1997

[30] Foreign Application Priority Data

Apr. 30, 1996 [CA] Canada ..... 2175439

[51] Int. Cl.[7] ..... C23C 2/28; C23C 22/72; C23C 22/82

[52] U.S. Cl. ..... 148/277; 148/512; 148/527; 148/529; 427/383.7; 427/405

[58] Field of Search ..... 148/242, 277, 148/512, 519, 527, 529; 427/383.7, 405

[56] References Cited

U.S. PATENT DOCUMENTS

| | | | |
|---|---|---|---|
| Re. 32,121 | 4/1986 | Gupta et al. | 428/656 |
| 4,156,042 | 5/1979 | Hayman et al. | 427/253 |
| 4,468,308 | 8/1984 | Scovell | 204/192 R |
| 4,714,632 | 12/1987 | Cabrera et al. | 427/255.1 |
| 4,737,381 | 4/1988 | Kilbane et al. | 148/277 |
| 4,929,473 | 5/1990 | Marquez et al. | 427/252 |
| 4,944,858 | 7/1990 | Murphy et al. | 204/192.15 |
| 5,128,179 | 7/1992 | Baldi | 427/252 |
| 5,139,824 | 8/1992 | Liburdi et al. | 427/252 |
| 5,208,069 | 5/1993 | Clark et al. | 427/226 |
| 5,224,998 | 7/1993 | Ohmi et al. | 118/720 |
| 5,265,793 | 11/1993 | Usui et al. | 228/127 |
| 5,270,081 | 12/1993 | Manier et al. | 427/534 |
| 5,334,416 | 8/1994 | Seong et al. | 427/252 |
| 5,364,659 | 11/1994 | Rapp et al. | 427/253 |
| 5,366,765 | 11/1994 | Milaniak et al. | 427/229 |
| 5,387,292 | 2/1995 | Morishige et al. | 148/276 |
| 5,403,629 | 4/1995 | Eichmann et al. | 427/576 |
| 5,413,642 | 5/1995 | Alger et al. | 148/239 |
| 5,413,700 | 5/1995 | Heyse et al. | 208/134 |
| 5,413,813 | 5/1995 | Clark et al. | 427/237 |
| 5,795,659 | 8/1998 | Meelu et al. | 428/610 |
| 5,873,951 | 2/1999 | Wynns et al. | 148/242 |

FOREIGN PATENT DOCUMENTS

| | | | |
|---|---|---|---|
| 219960 | 3/1986 | European Pat. Off. . | |
| 423345 | 4/1991 | European Pat. Off. . | |
| 900427 | 10/1951 | France . | |
| 584370 | 12/1969 | France . | |
| 2511396 | 2/1983 | France . | |
| 60 005 927 | 1/1985 | Japan . | |
| 6-10114 | 1/1994 | Japan | 148/277 |
| 986961 | 1/1983 | U.S.S.R. . | |
| 1502658 | 8/1989 | U.S.S.R. . | |
| 1018628 | 1/1966 | United Kingdom . | |
| 1483144 | 4/1975 | United Kingdom . | |
| 2233672 | 6/1990 | United Kingdom . | |
| 2234530 | 6/1990 | United Kingdom . | |

OTHER PUBLICATIONS

Chemical Abstracts, vol. 68, No. 12 Columbus, Ohio, U.S.—Abstract No. 52538 (Mar. 1968).

Metal Science and Heat Treatment, vol. 26, No. 9/10 New York, U.S.A. pp. 764–768 (Sep.–Oct. 1984).

The Effect of Time at Temperature on "Silicon–Titanium" Diffusion Coating on IN738 Base Alloy by M.C. Meelu and M.H. Loretto pp. 1241–1246 of Processing and Properties of Materials (no date).

(List continued on next page.)

*Primary Examiner*—George Wyszomierski
*Attorney, Agent, or Firm*—Arne I. Fors

[57] ABSTRACT

There is provided a surface alloyed component which comprises a base alloy with a diffusion barrier layer enriched in silicon and chromium being provided adjacent thereto. An enrichment pool layer is created adjacent said diffusion barrier and contains silicon and chromium and optionally titanium or aluminum. A reactive gas treatment may be used to generate a replenishable protective scale on the outermost surface of said component.

9 Claims, 3 Drawing Sheets

OTHER PUBLICATIONS

CVD Application of Anti–Thermal and Anti–Corrosive Silica Films to the Inner Walls of Steel Tubes by Kohzo Sugiyama and Tomonori Nagashima pp. 36–40 of J. Met. Finish. Soc. Japan—Jul. 1988, 39(7) 388–392.

The Effectiveness of Vapour–deposited $SiO_2$ Coatings in Preventing Carburization of Incoly 800H by E. Lang pp. 37–45 of Materials Science and Engineering, 88 (no month) (1987).

A Replacement for Sulfur Treatment in Ethane Cracking Paper written by R.E. Brown et al. (Apr. 1994).

The Coating of Internal Surfaces by PVD Techniques by J.A. Sheward Surface and Coatings Technology, 54/55 (1992) 297–302 (no month).

Amoco Anticoking Technology A Process for Inhibiting Coking in Pyrolysis Furnaces Paper written by D.M. Taylor et al. (for presentation at AIChE meeting Apr. 1994).

Erosion and Erosion–Corrosion Behavior of Chromized–Siliconized Steel by B.Q. Wang et al. (no date).

SURFACE ALLOYED HIGH TEMPERATURE ALLOYS

BACKGROUND OF THE INVENTION (i) Field of the Invention

The present invention relates to coating systems for the generation of protective surface alloys for high temperature metal alloy products. More specifically, the coating systems generate surface alloys having controlled microstructures functional to impart predetermined beneficial properties to said alloy products including enhanced coking resistance, carburization resistance and product longevity.

(ii) Description of the Related Art

Stainless steels are a group of alloys based on iron, nickel and chromium as the major constituents, with additives that can include carbon, tungsten, niobium, titanium, molybdenum, manganese, and silicon to achieve specific structures and properties. The major types are known as martensitic, ferritic, duplex and austenitic steels. Austenitic stainless generally is used where both high strength and high corrosion resistance is required. One group of such steels is known collectively as high temperature alloys (HTAs) and is used in industrial processes that operate at elevated temperatures generally above 650° C. and extending to the temperature limits of ferrous metallurgy at about 1150° C. The major austenitic alloys used have a composition of chromium, nickel and iron in the range of 18 to 38 wt. % chromium, 18 to 48 wt. % nickel, balance iron and alloying additives.

The bulk composition of HTAs is engineered towards physical properties such as creep resistance and strength, and chemical properties of the surface such as corrosion resistance. Corrosion takes many forms depending on the operating environment and includes carburization, oxidation and sulfidation. Protection of the bulk alloy is often provided by the surface being enriched in chromium oxide. The specific compositions of the alloys used represent an optimization of physical properties (bulk) and chemical properties (surface). The ability of addressing the chemical properties of the surface through a surface alloy, and physical properties through the bulk composition, would provide great opportunities for improving materials performance in many severe service industrial environments.

Surface alloying can be carried out using a variety of coating processes to deliver the right combination of materials to the component's surface at an appropriate rate. These materials would need to be alloyed with the bulk matrix in a controlled manner that results in a microstructure capable of providing the preengineered or desired benefits. This would require control of the relative interdiffusion of all constituents and the overall phase evolution. Once formed, the surface alloy can be activated and reactivated, as required, by a reactive gas thermal treatment. Since both the surface alloying and the surface activation require considerable mobility of atomic constituents, that is, temperatures greater than 700° C., HTA products can benefit most from the procedure due to their designed ability of operating at elevated temperatures. The procedure can also be used on products designed for lower operating temperatures, but may require a post heat treatment after surface alloying and activation to reestablish physical properties.

Surface alloys or coating systems can be engineered to provide a fall range of benefits to the end user, starting with a commercial base alloy chemical composition and tailoring the coating system to meet specific performance requirements. Some of the properties that can be engineered into such systems include: superior hot gas corrosion resistance (carburization, oxidation, sulfidation); controlled catalytic activity; and hot erosion resistance.

Two metal oxides are mainly used to protect alloys at high temperatures, namely chromia and alumina, or a mixture of the two. The compositions of stainless steels for high temperature use are tailored to provide a balance between good mechanical properties and good resistance to oxidation and corrosion. Compositions which can provide an alumina scale are favored when good oxidation resistance is required, whereas compositions capable of forming a chromia scale are selected for resistance to hot corrosive conditions. Unfortunately, the addition of high levels of aluminum and chromium to the bulk alloy is not compatible with retaining good mechanical properties and coatings containing aluminum and/or chromium are normally applied onto the bulk alloy to provide the desired surface oxide.

One of the most severe industrial processes from a materials perspective is the manufacture of olefins such as ethylene by hydrocarbon steam pyrolysis (cracking). Hydrocarbon feedstock such as ethane, propane, butane or naphtha is mixed with steam and passed through a furnace coil made from welded tubes and fittings. The coil is heated on the outerwall and the heat is conducted to the innerwall surface leading to the pyrolysis of the hydrocarbon feed to produce the desired product mix. An undesirable side effect of the process is the buildup of coke (carbon) on the innerwall surface of the coil. There are two major types of coke: catalytic coke (or filamentous coke) that grows in long threads when promoted by a catalyst such as nickel or iron, and amorphous coke that forms in the gas phase and plates out from the gas stream. In light feedstock cracking, catalytic coke can account for 80 to 90% of the deposit and provides a large surface area for collecting amorphous coke.

The coke can act as a thermal insulator, requiring a continuous increase in the tube outerwall temperature to maintain throughput. A point is reached when the coke buildup is so severe that the tube skin temperature cannot be raised any further and the furnace coil is taken offline to remove the coke by burning it off (decoking). The decoking operation typically lasts for 24 to 96 hours and is necessary once every 10 to 90 days for light feedstock furnaces and considerably longer for heavy feedstock operations. During a decoke period, there is no marketable production which represents a major economic loss. Additionally, the decoke process degrades tubes at an accelerated rate, leading to a shorter lifetime. In addition to inefficiencies introduced to the operation, the formation of coke also leads to accelerated carburization, other forms of corrosion, and erosion of the tube innerwall. The carburization results from the diffusion of carbon into the steel forming brittle carbide phases. This process leads to volume expansion and the embrittlement results in loss of strength and possible crack initiation. With increasing carburization, the alloy's ability of providing some coking resistance through the formation of a chromium based scale deteriorates. At normal operating temperatures, half of the wall thickness of some steel tube alloys can be carburized in as little as two years of service. Typical tube lifetimes range from 3 to 6 years.

It has been demonstrated that aluminized steels, silica coated steels, and steel surfaces enriched in manganese oxides or chromium oxides are beneficial in reducing catalytic coke formation. Alonizing™, or aluminizing, involves the diffusion of aluminum into the alloy surface by pack cementation, a chemical vapour deposition technique. The coating is functional to form a NiAl type compound and provides an alumina scale which is effective in reducing catalytic coke formation and protecting from oxidation and other forms of corrosion. The coating is not stable at temperatures such as those used in ethylene furnaces, and also is brittle, exhibiting a tendency to spall or diffuse into the base alloy matrix. Generally, pack cementation is limited to the deposition of only a single element, the co-deposition of other elements, for example chromium and silicon, being extremely difficult. Commercially, it is generally limited to the deposition of only a few elements, mainly aluminum. Some work has been carried out on the codeposition of two elements, for example chromium and silicon, but the process is extremely difficult and of limited commercial utility. Another approach to the application of aluminum diffusion coatings to an alloy substrate is disclosed in U.S. Pat. No. 5,403,629 issued to P. Adam et al. This patent details a process for the vapour deposition of a metallic interlayer on the surface of a metal component, for example by sputtering. An aluminum diffusion coating is thereafter deposited on the interlayer.

Alternative diffusion coatings have also been explored. In an article in "Processing and Properties" entitled "The Effect of Time at Temperature on Silicon-Titanium Diffusion Coating on IN738 Base Alloy" by M. C. Meelu and M. H. Lorretto, there is disclosed the evaluation of a Si—Ti coating, which had been applied by pack cementation at high temperatures over prolonged time periods.

Deleteriously, however, to date no coatings have been developed which, in the context of hydrocarbon processing at temperatures in the range 850 to 1100° C., have been found effective to reduce or eliminate catalytic coke deposition or to provide improved carburization resistance over a commercially viable operating life. A major difficulty in seeking an effective coating is the propensity of many applied coatings to fail to adhere to the tube alloy substrate under the specified high temperature operating conditions in hydrocarbon pyrolysis furnaces. Additionally, the coatings lack the necessary resistance to any or all of thermal stability, thermal shock, hot erosion, carburization, oxidation and sulfidation. A commercially viable product for olefins manufacturing by hydrocarbon steam pyrolysis must be capable of providing the necessary coking and carburization resistance over an extended operating life while exhibiting thermal stability, hot erosion resistance and thermal shock resistance.

SUMMARY OF THE INVENTION

It is therefore a principal object of the present invention to impart beneficial properties to HTAs through surface alloying to substantially eliminate or reduce the catalytic formation of coke on the internal surfaces of tubing, piping, fittings and other ancillary furnace hardware used for the manufacture of olefins by hydrocarbon steam pyrolysis or the manufacture of other hydrocarbon-based products.

It is another object of the invention to increase the carburization resistance of HTAs used for tubing, piping, fittings and ancillary furnace hardware whilst in service.

It is yet a further object of the invention to augment the longevity of the improved performance benefits derived from the surface alloying under commercial conditions by providing thermal stability, hot erosion resistance and thermal shock resistance.

In accordance with the present invention there are provided two distinct types of surface alloy structures, both generatable from the deposition of either of two coating formulations, Al—Ti—Si and Cr—Ti—Si, followed by appropriate heat treatments.

The first type of surface alloy is generated after the application of the coating material and an appropriate heat treatment following thereafter, forming an enrichment pool adjacent to the base alloy and containing the enrichment elements and base alloy elements such that an alumina or a chromia scale can be generated by reactive gas thermal treatment (surface activation), through the use of Al—Ti—Si and Cr—Ti—Si as the coating materials, respectively. This type of surface alloy is compatible with low temperature commercial processes operating at less than 850° C.

The second type of surface alloy is also produced using Al—Ti—Si or Cr—Ti—Si as the coating materials, however, the heat treatment cycle is such as to produce a diffusion barrier adjacent to the base alloy and an enrichment pool adjacent said diffusion barrier. Surface activation of this type of surface alloy produces a protective scale that is mainly alumina when using Al—Ti—Si as the coating material, and mainly chromia when using Cr—Ti—Si. Both scales are highly effective at reducing or eliminating catalytic coke formation. This type of surface alloy is compatible with high temperature commercial processes of up to 1100° C. such as olefins manufacturing by hydrocarbon steam pyrolysis.

The diffusion barrier is defined as a silicon and chromium enriched, reactively interdiffused layer containing intermetallics of the elements from the base alloy and the deposited materials. The enrichment pool is defined as an interdiffused layer containing the deposited materials and adjacent to the diffusion barrier, if formed, or the base alloy, which is functional to maintain a protective oxide scale on the outermost surface.

In its broad aspect, the method of the invention for providing a protective surface on a base alloy containing iron, nickel and chromium comprises depositing onto said base alloy elemental silicon and titanium with at least one of aluminum and chromium, and heat treating said base alloy to generate a surface alloy consisting of an enrichment pool containing said deposited elements on said base alloy.

More particularly, the method comprises depositing an effective amount of elemental silicon and titanium with at least one of aluminum and chromium at a temperature in the range of 300 to 1100° C. to provide an enrichment pool which contains 4 to 30 wt. % silicon, 0 to 10 wt. % titanium, 2 to 45 wt. % chromium and optionally 4 to 15 wt. % aluminum, the balance iron, nickel and any base alloying additives, and heat treating said base alloy at a temperature in the range of 600 to 1100° C. for a time effective to provide an enrichment pool having a thickness in the range of 10 to 300 $\mu$m.

In a preferred embodiment, the method of the invention which additionally comprises heat treating said base alloy at a temperature in the range of 600 to 1150° C. for a time effective to form an intermediary diffusion barrier between the base alloy substrate and the enrichment pool containing intermetallics of the deposited elements and the base alloy elements, said diffusion barrier preferably having a thickness of 10 to 200 $\mu$m and containing 4 to 20 wt. % silicon, 0 to 4 wt% titanium, and 10 to 85 wt. % chromium, the balance iron and nickel and any alloying additives. The protective surface is reacted with an oxidizing gas selected from at least one of oxygen, air, steam, carbon monoxide or carbon dioxide, alone, or with any of hydrogen, nitrogen or argon whereby a replenishable protective scale having a thickness of about 0.5 to 10 $\mu$m is formed on said enrichment pool.

In a further embodiment of the method of the invention, aluminum or chromium is replaced by an element selected from Groups IVA, VA and VIA of the Periodic Table, or manganese; or titanium is replaced by an element selected from Group IV of the Periodic Table capable of segregating to the outermost surface to form a stable protective scale, yttrium or cerium may be added to the composition to enhance the stability of the protective scale.

The surface alloyed component of the invention produced by the method broadly comprises a base stainless steel alloy containing iron, nickel and chromium, and an enrichment pool layer adjacent said base alloy, containing silicon and chromium, and optionally one or more of titanium or aluminum or elements selected from Groups IVA, VA and VIA of the Periodic Table, or manganese, cerium or yttrium, and the balance iron, nickel and any base alloying additives; or optionally, wherein said silicon and chromium and optionally one or more of titanium or aluminum or elements selected from Groups IVA, VA and VIA of the Periodic Table, or manganese, cerium or yttrium, have been applied to said base alloy under conditions effective to permit reactive interdiffusion between said base alloy and the deposited materials, whereby the enrichment pool is formed which is functional to form a replenishable protective scale on said outermost surface of said component. The enrichment pool composition preferably comprises silicon in the range of 4 to 30 wt. %, titanium in the range of 0 to 10 wt. %, chromium in the range of 2 to 45 wt. %, and optionally 4 to 15 wt. % aluminum.

The surface alloyed component preferably additionally comprises a diffusion barrier layer, adjacent said base stainless steel alloy, said diffusion barrier having a thickness in the range of between 10 to 200 $\mu$m, and containing intermetallics of the deposited elements and the base alloy elements; whereby the diffusion barrier and the enrichment pool are formed which are functional to reduce diffusion of mechanically deleterious constituents into said base alloy and to form a replenishable protective scale on said outermost surface of said component. In accordance with this embodiment, the silicon content in the diffusion barrier layer comprises silicon in the range of 4 to 20 wt. %, chromium in the range of 10 to 85 wt. %, and titanium in the range of from 0 to 4 wt. %; and said enrichment pool composition comprises silicon in the range of 4 to 30 wt. %, chromium in the range of 2 to 42 wt. %, and titanium in the range of between 5 to 10 wt. %, and optionally aluminium in the range of between 4 to 15 wt. %.

DESCRIPTION OF THE DRAWINGS

The products of the invention will now be described with reference to the accompanying drawings, in which.

DESCRIPTION OF THE PREFERRED EMBODIMENT

Figure 1:
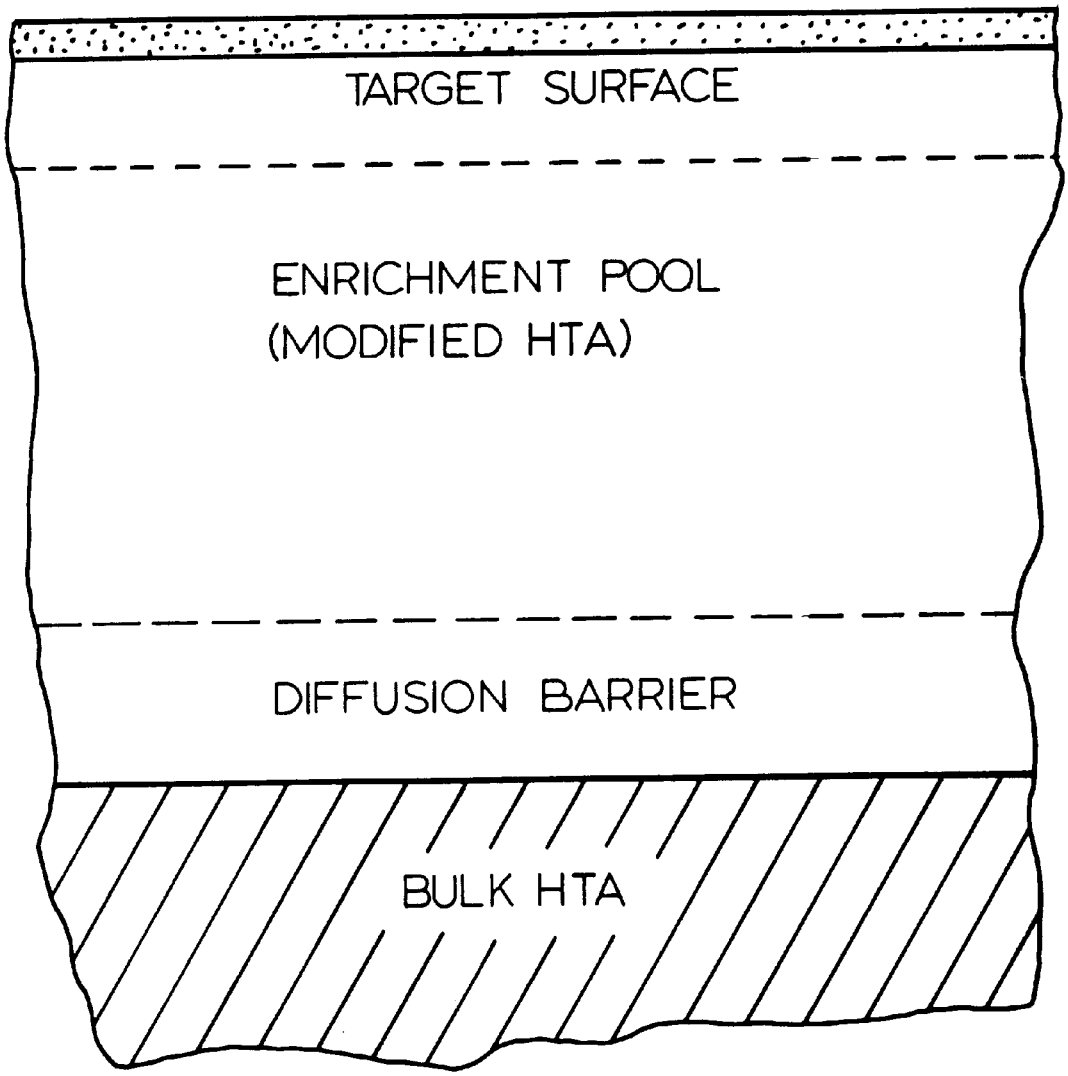
FIG. 1 is a schematic representation of a surface alloy after coating deposition, surface alloying, and surface activation.
Figure 2:
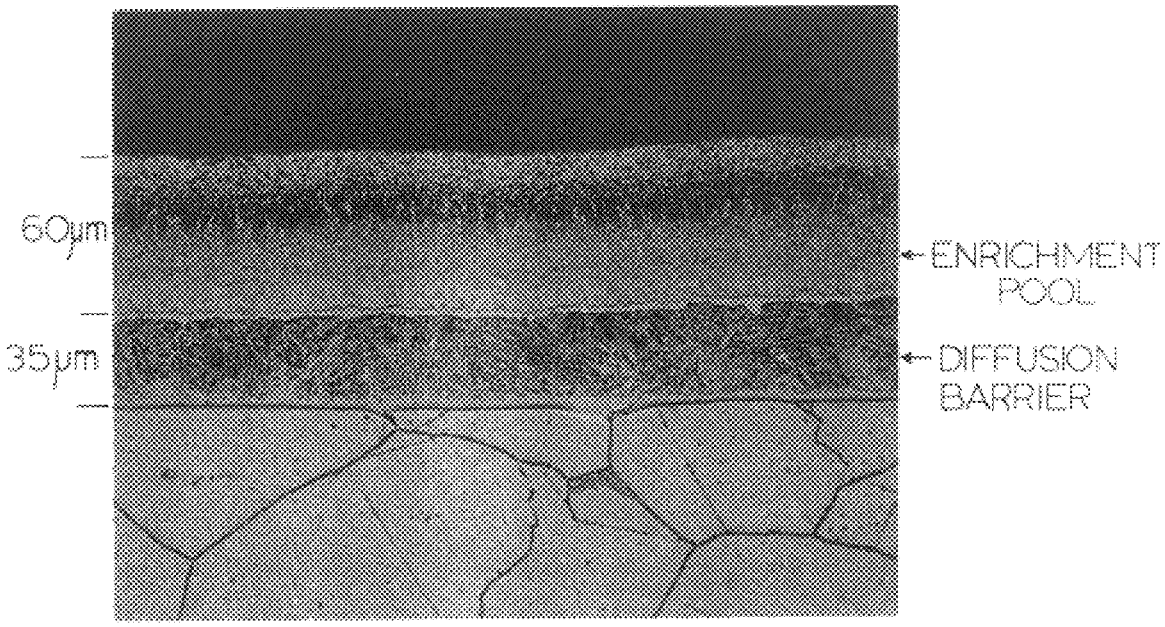
FIG. 2 is a photomicrograph depicting the microstructure of a surface alloy produced on a wrought 20Cr-30Ni—Fe alloy using the Al—Ti—Si coating formulation.
Figure 3:
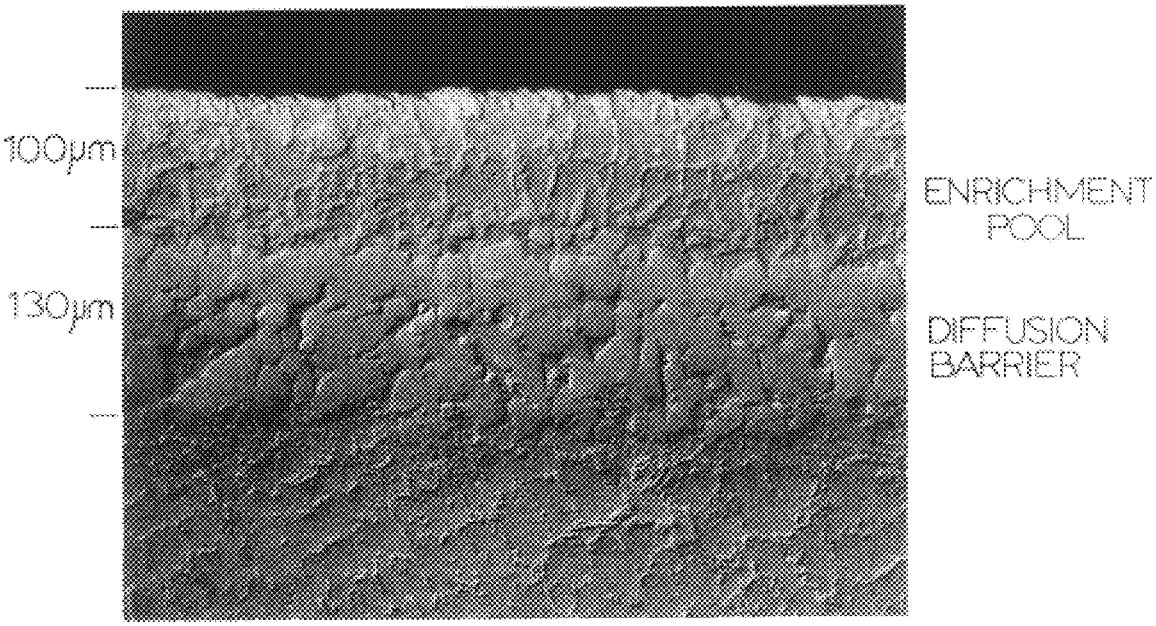
FIG. 3 is a photomicrograph depicting the microstructure of a surface alloy produced on a cast 35Cr-45Ni—Fe alloy using the Al—Ti—Si coating formulation.

Having reference to the accompanying figures, a process for producing surface alloyed components will now be described. Suitable base alloy compositions of components to be surface alloyed would include austenitic stainless steels.

Coating materials would be selected from elemental silicon and titanium, with one or more of aluminium, chromium, elements selected from Groups IVA, VA and VIA of the Periodic Table, manganese, cerium or yttrium. Titanium may be replaced with another element from Group IVA. The preferred elements would be titanium, aluminum and chromium in combination with silicon. However, satisfactory surface alloys may be prepared from chromium, titanium and silicon, in combination, or from aluminum, titanium and silicon, in combination. Additionally, an initial coating of silicon may be applied followed by a coating of the above-described admixtures to further enhance silicon enrichment. The elements selected will depend upon the requisite properties of the surface alloy.

For the Al—Ti—Si combination, aluminum would range from 15 to 50 wt. %, titanium would range from 5 to 30 wt. % and the balance silicon.

For the Cr—Ti—Si combination, chromium would range from 15 to 50 wt. %, titanium would range from 5 to 30 wt. % and the balance silicon.

Typical ranges for the average composition of the surface alloy layers formed on a wright 20Cr-30Ni—Fe alloy using Al—Ti—Si are shown in Table I.

TABLE I

| Wt. % | Diffusion Barrier | Enrichment Pool |
|---|---|---|
| Aluminum | 0 to 2 | 5 to 15 |
| Chromium | 20 to 40 | 2 to 10 |
| Silicon | 5 to 10 | 5 to 30 |
| Titanium | 0 to 2 | 5 to 10 |
| Iron, Nickel | Balance | Balance |

Typical ranges for the average composition of the surface alloy layers formed on a cast 35Cr-45Ni—Fe (supplier B) alloy using Al—Ti—Si are shown in Table II.

TABLE II

| Wt. % | Diffusion Barrier | Enrichment Pool |
|---|---|---|
| Aluminum | 0 to 5 | 4 to 15 |
| Chromium | 25 to 85 | 10 to 30 |
| Silicon | 4 to 20 | 4 to 15 |
| Titanium | 0 to 2 | 0 to 4 |
| Iron, Nickel | Balance | Balance |

It is to be noted that one of the advantages of the above-described coating is that a Ni:Ti:Si ratio of 4:2:1 respectively is functional to form a very stable compound in conjunction with the other elements. This stable coating does not diffuse into the substrate and maintains a high titanium and silicon content near the surface. An exemplary component composition would be 49.0 Ni-10.3Fe-3.5 Cr-22.7 Ti-13.3 Si and 1.4 of other components.

Selection of a Delivery Method for Coating Materials

The coating materials may be delivered to the surface of the component by a variety of methods whose selection is based on the composition of the coating, the temperature of the deposition, the required flux at the surface, the level of spacial homogeneity needed, and the shape of the component to be coated. The major coating technologies are identified below.

Thermal Spray methods include flame spray, plasma spray, high velocity oxy fuel (HVOF), and Low Pressure Plasma Spray (LPPS). They are all generally line-of-sight and are best suited for external surfaces. The use of robotic technology has improved their throwing power somewhat. New gun technologies have also been developed capable of coating the internal surfaces of piping products which are greater than 100 mm in inner diameter and lengths exceeding 5 meters.

Electrochemical and electroless methods have good throwing power for complex shapes but are limited in the range of elements which can be deposited.

Vapour based methods include pack cementation, thermal chemical vapour deposition (CVD), plasma enhanced chemical vapour deposition (PECVD), and physical vapour deposition (PVD). PVD methods are very diverse and include cathodic arc, sputtering (DC, RF, magnetron), and electron beam evaporation.

Other coating methods include sol gel and fluidized bed processes with the former capable of delivering a wide range of coating materials to both simple shaped and complex shaped components.

Hybrid methods combine more than one of the above to ensure that the engineered surface alloy microstructure can be generated from the constituent materials delivered, for example, CVD, followed by PVD, or electrochemical followed by PVD.

Each of the above methods has capabilities and limitations that define its applicability for the performance enhancement of the component required. The key delivery requirements of any method considered for a given coating formulation are geometry of the component to be coated, throwing power of the method, rate of deposition and uniformity of deposition.

All of the above methods can be used for delivery of coating materials to the external surfaces of a wide range of component geometries, each with well defined throwing power. The preferred methods for delivering a wide range of coating materials to the internal surfaces of complex shaped parts are PVD methods. This is due to the flexibility in the selection of consumable (coating) material, and the ability of assembling the coating consumable within the complex shaped part. An example in the coating of tubular products is given by J. S. Sheward entitled "The Coating of Internal Surfaces by PVD Techniques" published in the Proceedings of the 19th International Conference on Metallurgical Coatings and Thin Films, San Diego, Apr. 6–10, 1992.

The use of magnetron sputtering is well known in the art and detailed in the review by J. A. Thornton and A. S. Penfold entitled "Cylindrical Magnetron Sputtering" in Thin Film Processes, Academic Press (1987). Specific examples in the patent literature included U.S. Pat. Nos. 4,376,025 and 4,407,713 issued to B. Zega entitled "Cylindrical Cathode for Magnetically-Enhanced Sputtering" and "Cylindrical Magnetron Sputtering Cathode and Apparatus" respectively, and U.S. Pat. No. 5,298,137 to J. Marshall entitled "Method and Apparatus for Linear Magnetron Sputtering", claimed to enhance the uniformity of deposition.

In this invention, the production of a surface alloyed component is divided into four major steps:

(a) prefinishing, to generate a clean surface compatible with vapour based coating methods;

(b) coating deposition, to deliver the required coating materials for surface alloying;

(c) surface alloying, to generate a specific or preengineered microstructure; and (d) surface activation, to generate a protective scale by reactive gas treatment.

Steps (a) through (c) are required, step (d) is optional, as will be described below.

In step (a), prefinishing, a combination of chemical, electrochemical and mechanical methods are used to remove organic and inorganic contaminants, any oxide scale, and where present, the Bielby layer (a damage zone formed through cold working production processes). The prefinishing sequence used is defined by the bulk composition, the surface composition, and the component geometry. The thoroughness and uniformity of the prefinishing sequence is critical to the overall quality of the coated and surface alloyed product.

For step (b), coating deposition, the preferred methods of coating the innerwall surfaces of components such as tubing, piping and fittings are sputtering (DC or RF), with or without magnetron enhancement, and PECVD. Method selection is driven mainly by the composition of the coating material to be delivered to the component surface. With sputtering methods, magnetron enhancement can be used to reduce the overall coating time per component. In such cases, the target (or cathode) is prepared by applying the coating formulation on a support tube which has the shape of the component to be coated and a diameter less than that of the component. The support tube with the coating consumable material is then inserted within the component in a manner capable of delivering coating material uniformly. Application methods of the coating consumable onto the support tubing can include any of the coating methods perviously listed. Thermal spray methods were found to be the most useful for the range of coating materials required for components processed for the olefins manufacturing application. Magnetron enhancement of the sputtering process was carried out using either permanent magnets within the support tube or passing a high DC or AC current through the support tube to generate an appropriate magnetic field. The latter approach is based on electromagnetic theory specifying that the flow of an electric current through a conductor leads to the formation of circular magnetic induction lines normal to the direction of current flow for example, D. Halliday and R. Resnick, "Physics Part II" published by John Wiley & Sons, Inc. (1962). When using permanent magnets to generate the field, the composition of the support tube is unimportant, however, when using a high current, the support tube should be made of materials with low electrical resistance such as copper or aluminum. The process gas normally used is argon at pressures ranging from 1 to 200 mtorr, and if required, low levels of hydrogen (less than 5%) are added to provide a slightly reducing atmosphere. The component temperature during deposition is typically in the range of 300 to 1100° C.

For step (c), surface alloying can be initiated in part or carried out in parallel to this operation by depositing at sufficiently high temperatures of greater than 600° C. with well defined temperature-time and flux profiles, or it can be carried out upon completion of the deposition in the temperature range of 600 to 1150° C.

Step (d), surface activation, is considered optional in that the unactivated surface alloy can provide many of the targeted benefits, including coking resistance to some level. However, proper or complete activation can further increase overall coking resistance through the formation of a superior outermost scale. Activation can be carried out as part of the production process, or with the surface alloyed component in service. The latter being useful in regeneration of the protective scale if consumed (eroded) or damaged. When activation is carried out as part of the production process, it can be initiated during the surface alloying step, or after its completion. The process is carried out by reactive gas thermal treatment in the temperature range of 600 to 1100° C.

The product and process of the invention will now be described with reference to the following non-limitative examples.

EXAMPLE I

This example demonstrates the coking resistance of treated versus untreated tubes.

A laboratory scale unit was used to quantify the coking rate on the innerwall of a tube by running the pyrolysis process for 2 to 4 hours or until the tube was fully plugged with coke, whichever occurred first. The test piece typically was 12 to 16 mm in outer diameter and 450 to 550 mm in length. The tube was installed in the unit and the process gas temperature monitored over its full length to establish an appropriate temperature profile. Ethane feedstock was introduced to a steady state ratio of 0.3:1 of steam: hydrocarbon. The contact time used ranged from 100 to 150 msec and the cracking temperature was approximately 915° C. The sulfur level in the gas stream was approximately 25 to 30 ppm. The product stream was analyzed with a gas chromatograph to quantify product mix, yields and conversion levels. At the end of the run, the coke was burned off and quantified to calculate an average coking rate. After the decoke, the run typically was repeated at least once.

The results for 6 treated tubes are reported in Table III, identifying the coating materials used for the treatment and the tube innerwall surface being tested for coking resistance. Quartz is used as a reference representing a highly inert surface with no catalytic activity. The formation and collection of amorphous coke from the gas phase is considered independent of the catalytic coke formed at the tube surface and can account for up to 1 mg/min, depending on the collection area (surface area or roughness) at the tube surface. Therefore, a surface with no catalytic activity is expected to exhibit a coking rate of 0 to 1 mg/min due simply to the collection of amorphous coke. Differences within this range are considered unimportant and ascribable to differences in surface roughness. Metal reference tube runs are also shown with their test results taken from a database of the test unit. The 20Cr-30Ni—Fe metal reference alloy is considered the lowest alloy used in olefins manufacturing and exhibits the highest coking rate of 8 to 9 mg/min. With such a coking rate, the test tube is fully plugged (coked) in less than 2 hours. Higher alloys tested (richer in Cr and Ni) provide an improvement with a reduction in coking rate to 4 to 5 mg/min.

The results show that the metal treated tubes perform as good as the quartz reference tube. The remaining challenge, as described earlier, is in producing a surface alloy that exhibits excellent coking resistance, while also exhibiting the other properties required for commercial viability i.e., (carburization resistance, thermal stability, hot erosion resistance and thermal shock resistance).

TABLE III

Pyrolysis Test Results of Treated and Untreated Tubes

| Tube Samples | Coating Materials | Major Surface Species in Test | Coking Rate (mg/min) |
|---|---|---|---|
| A | Si (treatment 1) | chromia & silica | 0.65, 0.64 |
| B | Si (treatment 2) | chromia & silica | 1.06; 1.02 |
| C | Ti—Si | chromia & titania | 0.48; 0.60 |
| D | Cr | chromia | 0.51; 0.73 |
| E | Cr—Ti—Si | chromia | 0.67; 0.66; 0.79 |
| F | Al—Ti—Si | alumina | 0.68; 0.38 |
| Quartz reference for A, B, C and D | none (untreated) | silica | 0.34; 0.40 |
| Quartz reference for E | none (untreated) | silica | 0.42; 0.36 |
| Quartz reference for F | none (untreated | silica | 0.23 |
| Metal Reference 1 (20Cr-30Ni-Fe) | none (untreated) | mixture of bulk metals and their oxides | 8 to 9 (from database) |
| Metal Reference 2 (higher base alloys) | none (untreated) | mixture of bulk metals and their oxides | 4 to 5 (from database) |

EXAMPLE II

This example is included to demonstrate the lack of carburization following accelerated carburization and aging tests.

Two accelerated test methods have been used to evaluate carburization resistance. The first method (Accelerated Carburization Method 1) comprises a cycle of ~24 h duration and consists of ethane pyrolysis at 870° C. for 6 to 8 hours to deposit carbon on the test piece surface, followed by an 8 hour soak at 1100° C. in a 70% hydrogen and 30% carbon monoxide atmosphere to diffuse the deposited carbon into the test piece, and finally, a coke burn off at 870° C. using steam/air mixtures and lasting 5 to 8 hours. Under these conditions, wrought tubing of the 20Cr-30Ni—Fe alloy composition with a 6 mm wall thickness typically carburizes through to one half of the wall thickness after 15 to 16 cycles. This level of carburization is normally seen at the end of the service cycle of tube products in commercial furnaces and can therefore be considered to represent one tube lifetime.

Figure 4:
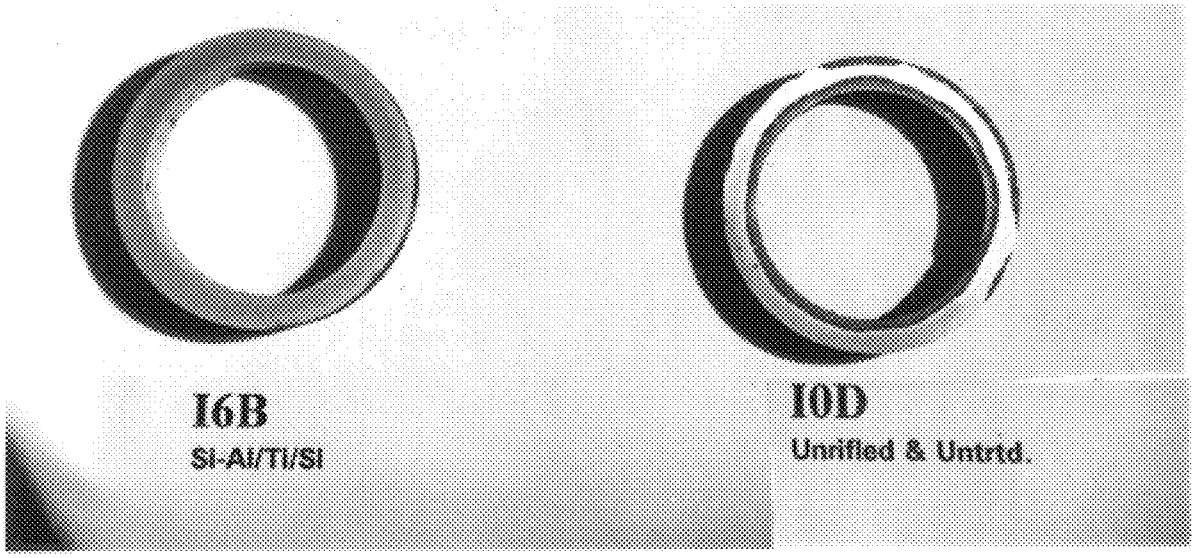
FIG. 4 is a photograph showing a treated sample (left) and an untreated sample (right) of the results of the accelerated carburization test method 1 after 22 cycles.

A total of 9 surface alloys have been tested using the above procedure. All of the surface alloys passed the test with either minimal or no carburization whatsoever. FIG. 4 shows one of the treated tubes (sample on left) showing excellent carburization resistance alongside an untreated tube after 22 cycles.

The second test method (Accelerated Carburization Method 2) used to evaluate carburization resistance is more severe than Method 1 in that a thick layer of carbon is initially painted on the test piece surface, followed with a hot soak at 1100° C. in a 70% hydrogen and 30% carbon monoxide atmosphere for 16 hours. The sample is removed from the test unit, additional carbon is repainted and the cycle is repeated. Three such cycles are sufficient to fully carburize the 6 mm wall thickness of untreated tubes of the wrought 20Cr-30Ni—Fe composition. The test is considered more severe than Method 1 due to the longer duration of the soak portion of the cycle, and because the test does not allow the surface to recover in any way with a protective scale. The surface alloys considered commercially viable have passed this test. The test is intended to provide a relative ranking.

EXAMPLE III

This example is included to demonstrate the superior hot erosion resistance of treated alloys.

Hot erosion resistance is carried out to evaluate scale adherence and erosion rates of surface alloyed components. Tube segments are heated to 850° C. and are exposed to air. Erodent particles are propelled towards the test surface at a predefined speed and impact angle. The weight loss of the sample is quantified for a fixed load of particles (total dosage).

A total of five surface alloy-base alloy combinations have been tested. In all cases, as shown in Table IV, weight loss measurements show that the erosion resistance of surface alloyed components is 2 to 8 times that of untreated samples. The Al—Ti—Si systems on a cast alloy exhibited the lowest erosion rate of the systems tested.

TABLE IV

Hot Erosion Test Results

| Base Alloy | Coating Materials used for Surface Alloy | Weight Loss (mg) 30° impingement | Weight Loss (mg) 90° impingement |
|---|---|---|---|
| 20Cr—30Ni—Fe wrought | Cr—Ti—Si (sample A) | 8.9 | 7.4 |
| | (sample B) | 13.9 | 10.7 |
| | none (reference) | 45.3 | 57.8 |
| 35Cr—45Ni—Fe (cast, supplier A) | Al—Ti—Si | 4.9 | |
| | Cr—Ti—Si | 4.2 | |
| | None (reference) | 9.8 | |
| 35Cr—45Ni—Fe (cast, supplier B) | Al—Ti—Si | 1.2 | |
| | Cr—Ti—Si | 2.2 | |
| | None (reference) | 9.3 | |

EXAMPLE IV

This example is included to demonstrate the thermal stability of treated alloys.

Thermal stability testing is carried out to ensure the survivability of a surface alloy at the operating temperatures of commercial furnaces. Test coupons are annealed in an inert atmosphere at various temperatures in the range of 900 to 1150° C. for up to 200 hours at each temperature. Any changes in structure or composition are quantified and used to project the maximum operating temperature for a given surface alloy.

The results for the cast alloy 35Cr-45Ni—Fe from supplier B indicate that both the Al—Ti—Si and the Cr—Ti—Si systems can be operated at temperatures of up to 1100°C. A temperature of up to 1125° C. can be used for the Cr—Ti—Si system but may lead to a slow deterioration of the Al—Ti—Si system. The Cr—Ti—Si system begins to deteriorate at temperatures exceeding 1150° C. Olefins manufacturing plants generally use a maximum outer tube wall temperature of 1100° C., and in most cases operate below 1050° C.

EXAMPLE V

This example is included to demonstrate the thermal shock resistance of surface alloyed parts.

Thermal shock resistance testing is used to evaluate the ability of the surface alloy to withstand emergency furnace shutdowns in service when large temperature changes may occur over a very short time. The test rig evaluates tube segments by gas firing of the outerwall surface to a steady state temperature of 950 to 1000° C. for 15 minutes followed by rapid cooling to approximately 100° C. or lower in about 15 minutes. A test sample undergoes a minimum of 100 such cycles and is then characterized.

Both the Al—Ti—Si and the Cr—Ti—Si systems passed this test with no deterioration. The systems on the wrought tube alloy 20Cr-30Ni—Fe were tested for a total of 300 cycles with no deterioration observed. Untreated reference samples in all cases exhibited severe chromium loss after 100 cycles.

It will be understood, of course, that modifications can be made in the embodiments of the invention illustrated and described herein without departing from the scope and purview of the invention as defined by the appended claims.

We claim:

1. A method of providing a protective surface made up of a surface alloy-enrichment pool on a base alloy containing iron, nickel chromium and alloying additives comprising: depositing onto said base alloy an effective amount of elemental silicon, aluminum, and titanium or chromium, and heat treating said base alloy at a temperature in the range of 600 to 1150° C., to generate a surface alloy consisting of an enrichment pool which contains 4 to 30 wt. % silicon, 0 to 10 wt. % titanium, 2 to 45 wt. % chromium and 0 to 15 wt. % aluminium with the balance thereof being iron, nickel and any base alloying additives said enrichment pool having a thickness in the range of 10 to 300 $\mu$m whereby said enrichment pool is functional to reduce the deposition of catalytically formed coke thereon.

2. A method as claimed in claim 1 which additionally comprises further heat treating said base alloy and attendant surface alloy at a temperature in the range of 600 to 1150° C. for a time effective to form an intermediary diffusion barrier between the base alloy substrate and the surface alloy containing intermetallics of the deposited elemental silicon, and one or more of chromium, titanium or aluminum, and the base alloy elements.

3. A method as claimed in claim 2, in which the diffusion barrier contains 4 to 20 wt. % silicon, 0 to 5 wt. % aluminum, 0 to 4 wt. % titanium, and 10 to 85% chromium, the balance thereof being iron and nickel and any alloying additives.

4. A method as claimed in claim 3, in which the diffusion barrier has a thickness in the range of about 10 to 200 $\mu$m.

5. A method as claimed in claim 2, which comprises additionally adding yttrium or cerium before first heating of the base alloy to enhance the stability of said surface alloy.

6. A method as claimed in claim 1, further comprising reacting said protective surface with an oxidizing gas whereby a replenishable protective scale is formed on said enrichment pool.

7. A method as claimed in claim 6, in which the oxidizing gas is selected from the group consisting of oxygen, air, steam, carbon monoxide and carbon dioxide, alone, or with any of hydrogen, nitrogen or argon.

8. A method as claimed in claim 7, in which the protective scale has a thickness of about 0.5 to 10 $\mu$m.

9. A method as claimed in claim 1, which comprises additionally adding yttrium or cerium before heating of the base alloy to enhance the stability of said surface alloy.

* * * * *